United States Patent [19]

Thomas et al.

[11] 4,170,499

[45] Oct. 9, 1979

[54] METHOD OF MAKING HIGH STRENGTH, TOUGH ALLOY STEEL

[75] Inventors: Gareth Thomas, Berkeley; Bangaru V. N. Rao, Albany, both of Calif.

[73] Assignee: The Regents of the University of California, Berkeley, Calif.

[21] Appl. No.: 942,267

[22] Filed: Sep. 14, 1978

Related U.S. Application Data

[63] Continuation-in-part of Ser. No. 827,252, Aug. 24, 1977.

[51] Int. Cl.[2] ..... C21D 1/22

[52] U.S. Cl. ..... 148/143; 148/134; 148/36; 148/38

[58] Field of Search ..... 75/124, 128 C, 128 H, 75/128 R; 148/36, 38, 12 F, 12.4, 134, 143

[56] References Cited

U.S. PATENT DOCUMENTS

| | | | |
|---|---|---|---|
| 2,791,500 | 5/1957 | Foley et al. | 148/36 |
| 3,165,402 | 1/1965 | Finkl | 75/128 R |
| 3,254,991 | 6/1966 | Shimmin et al. | 75/128 R |
| 3,366,471 | 1/1968 | Hill et al. | 75/128 R |
| 3,379,582 | 4/1968 | Dickinson | 75/128 R |
| 3,532,560 | 10/1970 | Tomioka et al. | 148/12.4 |
| 3,723,101 | 3/1973 | Hunt | 75/128 R |
| 3,944,442 | 3/1976 | Donachie | 148/12.4 |
| 4,052,230 | 10/1977 | Aylward | 148/12.4 |

OTHER PUBLICATIONS

McMahon et al., "Development of Economically Tough, Ultra-High-Strength Fe-Cr-C Steels," Proc. Third Intern. Conf. on Strength of Metals and Alloys, Cambridge, Inst. Met., 1973, 1, p. 180.

*Primary Examiner*—Arthur J. Steiner
*Attorney, Agent, or Firm*—Flehr, Hohbach, Test, Albritton & Herbert

[57] ABSTRACT

A high strength, tough alloy steel, particularly suitable for the mining industry, is formed by heating the steel to a temperature in the austenite range (1000°-1100° C.) to form a homogeneous austenite phase and then cooling the steel to form a microstructure of uniformly dispersed dislocated martensite separated by continuous thin boundary films of stabilized retained austenite. The steel includes 0.2-0.35 weight % carbon, at least 1% and preferably 3-4.5% chromium, and at least one other subsitutional alloying element, preferably manganese or nickel. The austenite film is stable to subsequent heat treatment as by tempering (below 300° C.) and reforms to a stable film after austenite grain refinement.

9 Claims, 13 Drawing Figures

FIG. 3
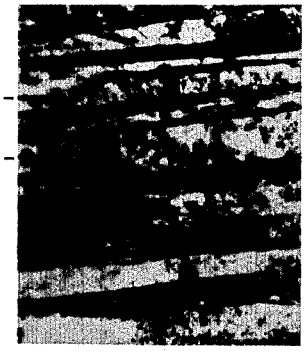
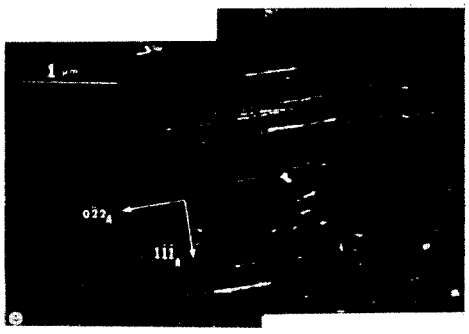
FIG. 2
FIG. 4
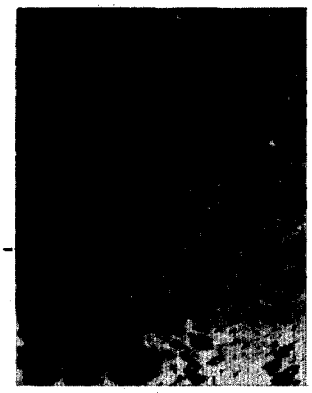
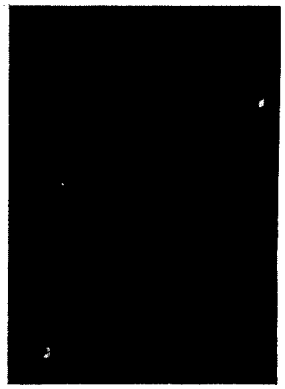
FIG. 5
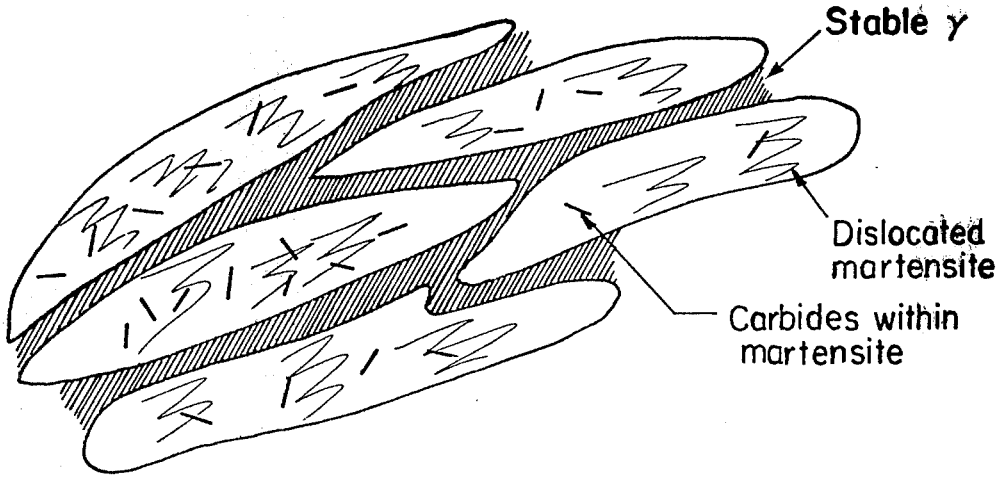
FIG. 1

SINGLE HEAT TREATMENTS

Treatment P

Treatment T

GRAIN REFINING DOUBLE TREATMENTS

Treatment R

Treatment U

METHOD OF MAKING HIGH STRENGTH, TOUGH ALLOY STEEL

The United States Government has rights in this invention pursuant to Contract No. W-7405-ENG-48 awarded by the U.S. Energy Research and Development Administration.

CROSS-REFERENCE TO RELATED APPLICATION

This application is a continuation-in-part of our copending application, Ser. No. 827,252, filed Aug. 24, 1977, entitled "High Strength, Tough Alloy Steel".

BACKGROUND OF THE INVENTION

The present invention relates to a high strength, tough medium carbon alloy steel.

High strength structural steels are used extensively for components such as aircraft landing gear, missiles, rocket casings, armor plate and other defense applications. In addition, where such steels have high hardness and consequent abrasion resistance, they are used in mining operations (e.g., buckets for mining, comminution and other mineral processing operations). Also, the high strength steels can be substituted for other low strength steels for a saving in weight of structural components for use in bridges, buildings, ship building, automobile parts and the like. The limiting factor in the use of high strength steels is their toughness. In practice, toughness and ductility are required to resist crack propagation and ensure sufficient formability for successful fabrication of the steel into engineering components. Thus, there is a need for a high strength tough steel. For the mining industry, it would be a significant advantage to impart a high degree of hardness (e.g., $R_c$ hardness value of greater than 40) to such steels for use in buckets, liners, balls, and the like.

One high strength steel available commercially is designated SAE 4340. It has acceptable yield strength and hardness. However, it is characterized by a room temperature Charpy-V-Notch impact toughness of on the order of 10 ft-lbs. This is an unacceptably low value to resist the propagation of cracks under impact loading conditions.

A high strength, tough alloy steel is disclosed in J. McMahon and G. Thomas, Proc. Third Intern. Conf. on the Strength of Metals and Alloys, Cambridge, Inst. Metals, London, 1973, 1, p. 180. The disclosed product is a ternary iron-chromium-carbon steel. It discloses a microstructure including thin sheets of highly deformed retained interlath austenite surrounding the martensitic crystal laths. At page 181, it is stated that upon tempering at 200° C., the austenite was observed less frequently while upon tempering at 400° C. none was seen. The authors concluded that such tempering caused the retained austenite to transform to ferrite, followed by precipitation of interlath carbides, accompanied by a drop in toughness. An iron/0.35 weight % carbon/4 weight % chromium alloy exhibited a Charpy-V-Notch value of 12–15 ft/lbs and a plane strain fracture toughness ($K_{Ic}$) on the order of 70 KSI-in$^{\frac{1}{2}}$.

SUMMARY OF THE INVENTION AND OBJECTS

In accordance with the present invention a high strength, tough alloy steel is formed including 0.20 to 0.35% carbon, at least 1% chromium, and at least 1% of one or more other substitutional alloying elements, preferably manganese and/or nickel. This product is characterized by a microstructure of uniformly dispersed dislocated martensite cyrstals formed by martensite transformation. The crystals are separated from each other by continuous thin interlath boundary films of stabilized austenite and thus essentially free of boundary carbides. The structure includes fine autotempered carbides dispersed in the martensite. The steel is formed by heating to the austenite range and then cooling to transform most of the austenite to martensite at a temperature of at least 250° C. The other substitutional alloying elements (especially nickel) stabilize the austenite film against transformation during subsequent heat treatments such as tempering to as high as 300° C. or more permits the reformation of such stable austenite after austenite grain refinement. Such alloying elements also stabilize the retained austenite to mechanical deformation. The product is characterized by a combination of excellent yield strengths, Charpy impact energy, plane strain fracture toughness, hardness, and a superior ratio of tensile strength to yield strength. A preferred alloy composition includes 0.20–0.35 weight % carbon, 3.0–4.5 weight % chromium, and a further substitutional element of manganese (1 to 2 weight %) or nickel (3 to 5 weight %) or combinations of the same.

It is an object of the invention to produce a high strength, tough alloy steel which is superior to the alloy steels of the prior art.

It is a particular object of the invention to product such an alloy steel with a combination of high yield strength, impact toughness, and plane strain fracture toughness.

It is a further object of the invention to provide a steel of the foregoing type with a microstructure of dislocated martensite crystals separated by austenite films which are stable to heat treatment and mechanical deformation.

It is a specific object of the invention to provide a versatile alloy steel of set composition capable of a wide degree of physical property modification by varying heat treatment.

It is another object of the invention to provide a very hard alloy steel of the foregoing type suitable to resist abrasion for mining and other applications.

Further objects and features of the invention will be apparent from the following description of the preferred embodiments taken in conjunction with the accompanying drawings.

BRIEF DESCRIPTION OF THE DRAWINGS

FIG. 1 is a schematic representation of the microstructure of the alloy steel of the present invention.

FIGS. 2 and 3 are a set of transmission electronmicrographs (bright and dark fields, respectively) showing dislocated parallel martensite crystals surrounded by interlath films of stabilized austenite for an Fe/4% Cr/0.3% C/2% Mn steel. The scale in FIG. 3 is the same as in FIG. 2 (magnification ~ 16000x).

FIGS. 4 and 5 are a set of transmission electronmicrographs (bright and dark fields, respectively) at magnifications the same as those of FIGS. 2 and 3 illustrating the carbides within the disclosed martensite of FIGS. 2 and 3.

DETAILED DESCRIPTION OF THE PREFERRED EMBODIMENTS

Figure 6:
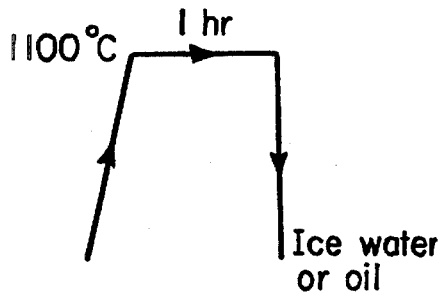
FIGS. 6–9 are diagrammatic representations of the various heat treatments in the alloy steel of the present invention.

Briefly described, the present invention relates to a high strength, tough alloy steel of a particular chemical composition and microstructure. It includes about 0.20 to 0.35 weight % carbon, at least 1 weight % chromium, and at least 1 weight % of one or more other substitutional alloying elements, preferably manganese or nickel. This alloy is heated into the austenite range and then quenched to form a microstructure of uniformly dispersed martensite crystals, a major portion of which are in dislocated form, separated from each other by substantially continuous thin boundary films of stabilized retained austenite essentially free of carbides. Autotempered carbides are dispersed in the martensite increasing toughness. This microstructure is achieved by a combination of heat treatment and the presence of the specified alloying elements. In general, the microstructure may be considered to be a microduplex structure in which the major phase martensite contributes to the strength of the steel while the minor phase retained austenite promotes toughness by its crack blunting and/or crack branching ability, without adversely lowering the strength of the steel. Also, the steel derives toughness from the martensite phase itself due to the absence of substructural twinning and the removal of some of the carbon from solution in the form of fine interlath dispersions of autotempered carbides.

A major feature of the invention is the discovery that the presence of substitutional alloying elements in addition to chromium in a medium carbon steel stabilizes the interlath films of retained austenite against conversion to ferrite during subsequent heat treatment. Thus, such other substitutional elements, such as manganese and nickel, permit the increase in toughness of the final product without a reduction of strength. The presence of such elements permits a wide range of mechanical properties for a single alloy of the same chemical constituents by varying heat treatment as by tempering or grain refinement.

The properties of the alloy steel of the present invention are determined by a combination of the chemical constituents present and by heat treatment. Although such constituents act in combination, for simplicity of description, the major effects of individual constituents will be discussed. However, it should be understood that this is an approximation only of the complex interplay among the alloying elements.

Prior to discussing the specific contributions of the chemical constituents, it is important to understand the basic temperature transformations of the microstructure of the steel forming the subject product. In the first transformation, the alloy steel is heated to a temperature above the austenite transformation temperature to form a homogeneous austenite phase with the alloying elements in solution. This step is termed austenitization. A suitable temperature for this purpose is on the order of 1000°-1100° C. Above this temperature, there is a tendency for austenite grain growth which, if excessive, could cause the final product to be subject to cracking. It is preferable to heat to minimum temperature which accomplishes austenitization. In general, it has been found that for each inch thickness of specimen, about one hour holding time is sufficient.

A second heat treatment is martensite transformation to form the microstructures set forth above including dislocated martensite laths separated by thin boundary films of stabilized retained deformed austenite. The temperature at which the austenite begins to transform to martensite, designated $M_s$, largely determines whether the martensite will be in a twinned or dislocated form. At lower temperatures, the product tends to be twinned which imparts poor toughness characteristics. It has been found that the martensite transformation temperature should be at least about 250° C. and, preferably higher, say at least about 300° C.

The total alloy content of the steel determines the martensite transformation temperature. Thus, from a temperature in the range of 500° to 600° C. each alloy element provides a depression of the $M_s$ temperature characteristic to the specific element. By far the most significant depressant is carbon which lowers the $M_s$ transformation 420° C. for each weight % in the composition. Other values for alloying elements on the weight % solute per lowered ° C. of $M_s$ temperature are molybdenum-7, chromium-12, nickel-17, and manganese-30. These values are set forth in Thomas, G.: Iron and Steel Intern., 46: 451 (1973).

The carbon content of a martensitic steel provides a significant degree of strength to the steel. However, above about 0.35 weight % carbon, the martensitic steel begins to receive a significant portion of its strength from substructural twinning. This type of strengthening is deleterious to toughness. Such increased strength without a corresponding increase in toughness would only result in poor utilization of the available strength of steel in engineering applications where resistance to propagation of existing cracks is important. Thus, the maximum carbon content to provide the desired microstructure and corresponding properties to the steel of the present invention is about 0.35 weight % carbon. The lower end of the carbon range may be as low as 0.20 weight % carbon and preferably is above 0.25 weight % carbon. The carbon content may be varied in this range depending on the desired properties of the final product.

Another important alloying element is chromium. It contributes to the hardenability of the steel and assists in retaining the austenite intralath films to separate the martensite crystals during martensitic transformation, a major factor in providing high toughness to the steel. The presence of the chromium and other alloying elements permit the hardenability of the steel to fully optimize the microstructure by martensite transformation in a practical time frame. The minimum chromium content is about 1.0 weight %. Preferably, it should be present at a level of 3.0 to 4.5 weight % which results in the desired amount of retained austenite film (e.g., on the order of 5 volume %) in the microstructure. The chromium also contributes to the formation of a dislocated lath martensite. In addition, the chromium provides corrosion resistance of the product. If desired, the level of chromium may be below 3 weight % by substitution of some other alloying element, such as molybdenum, if desired for the formation of a steel of a particular type.

An important feature of the present invention is the presence of at least 1 weight % of at least one other substitutional alloying element in addition to the chromium content of the steel. It has been found that manganese and/or nickel improve the toughness of an iron-chromium-carbon base steel at a given strength and also improves its hardenability. In addition, these substitutional elements are austenite stabilizers both during martensitic transition and thereafter to provide an increase in the amount of retained austenite. It is believed that this is the reason why they contribute to toughness of the final product. The presence of these substitutional elements (especially nickel) permits subsequent heat treatments such as tempering or grain refinement without the loss of the austenite boundary films. Such elements (especially manganese and nickel) also stabilize the austenite film to mechanical deformation. This provides considerable versatility to the properties of the alloy steel depending upon the heat treatment.

If manganese is employed as the substitutional alloying element, it is suitably employed in a range of 1 to 2 weight %. Above this level, it may promote undesirable substructural twinning. On the other hand, nickel can be added in large amounts before adverse twinning occurs. Thus, a suitable range of nickel is on the order of 3 to 5 weight %. Combinations of nickel and manganese may be employed, if desired, with a corresponding decrease in the level of one alloying element due to the presence of the other one.

If desired for specific purposes, other substitutional alloying elements may also be employed to contribute to properties such as stabilization of the austenite films between the martensitic crystals. Such other substitutional alloying elements include molbydenum, cobalt, silicon, aluminum, and mixtures of the same with each other or with nickel or manganese.

The microstructure of the present invention is an important factor in contributing to the high strength and toughness of the present medium carbon steel. It includes the following features:

(a) maintenance of dislocated lath martensite.

(b) promotion of a fine dispersion of carbides in martensite either through auto-tempering or tempering following quenching.

(c) promotion of ductile interlath films of retained austenite.

(d) elimination of coarse undissolved alloy carbides and interlathed martensite carbides.

Referring to FIG. 1, a schematic view of the microstructure of the present invention is illustrated. A series of martensite crystals in the form of laths are separated by thin films of stable austenite (gamma iron). A major portion of the martensite is in dislocated form, preferably in excess of 75% dislocated to as high as all dislocated (in contrast to twinning). The ratio of martensite to stable retained deformed austenite is not critical so long as there is sufficient austenite to separate the martensite crystal to provide toughness. A level of about 5 volume % or less austenite has been found to be sufficient for this purpose.

The austenite phase is retained in a deformed state and in stabilized condition after austenitizing and quenching for martensitic transformation. The effect of heat treatment on the austenite will be described in more detail below. However, for emphasis, it is important to note that the alloy carbides are essentially all dissolved during austenitizing. In addition, it is important to avoid interlath martensite carbides which adversely effect the final product.

It has been found that fine autotempered carbide of the alloying elements are dispersed within the martensite. Such carbides contribute to the toughness without significant decrease in strength of the final product.

The martensite crystals are characterized generally by a lath configuration. As set forth above, it is important that the martensite be in a dislocated form. This feature is best illustrated in FIGS. 2 and 3. The latter figure in a dark field shows the lath films of stabilized austenite in an iron/4% chromium/0.3% carbon/2% manganese steel. FIG. 2 shows the same austenite and dislocated martensite.

Referring to FIGS. 4 and 5, the fine carbides within the martensite crystal of the steel of FIGS. 2 and 3 as illustrated at a 16000x magnification. The carbides are illustrated in FIG. 4 within the martensite crystals. In FIG. 5, only the carbide crystals are visible.

As set forth above, heat treatment plays an important role in forming the microstructure and corresponding properties of the present invention. During austenitizing, the steel is heated to say, 1000°-1100° C. to ensure dissolution of carbides in the austenite. Such high austenitizing temperature results in relatively coarse prior austenite grain sizes (e.g., 200°-250 micron grain diameter). The heat treatment affects the microstructure and properties of the final product. The following table sets forth the designations for a variety of heat treatments for use in accordance with the present invention:

Table I

HEAT-TREATMENT DESIGNATIONS

| Treatment | Symbol |
|---|---|
| 1100° C. (1 hr) → quench (oil or water) | P |
| P + Temper (200° C., 1 hr) | Q |
| Q + 870° C. (1 hr) → quench (oil) | R |
| R + Temper (200° C.) | S |
| 1100° C. (1 hr) → Temper (200° C., 1-5 min) → quench (oil or water) | T |
| T + 870° C. (1 hr) → quench (oil) | U |
| U + Temper (200° C.) | V |
| 1100° C. (1 hr) → Air cool | W |

Treatment P, illustrated schematically in FIG. 6, is the basic process for forming the desired microstructure. The steel is heated above the austenite transformation temperature, suitably to a temperature in the range of 1000° C. to 1100° C., to form a homogeneous austenite phase with the alloying elements in solution. Thereafter, the alloy steel is cooled by quenching as in ice water or oil at a sufficient rate to transform the major portion of austenite to martensite in the foregoing microstructure at a temperature of at least 250° C. This procedure alone is capable of forming the high strength tough steel for a iron/chromium/carbon/manganese alloy.

Treatment Q, after quenching in treatment P, the steel is tempered below the austenite transformation line at an intermediate low temperature (e.g., 200°-250° C.). This procedure is suitable for the iron/chromium/carbon/manganese alloy. It provides the following improvements in properties: it provides a substantial improvement in toughness without a significant loss in strength.

Figure 8:
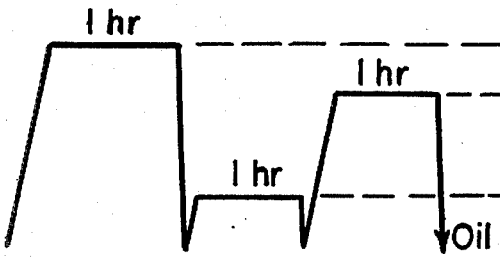
Figure 12:
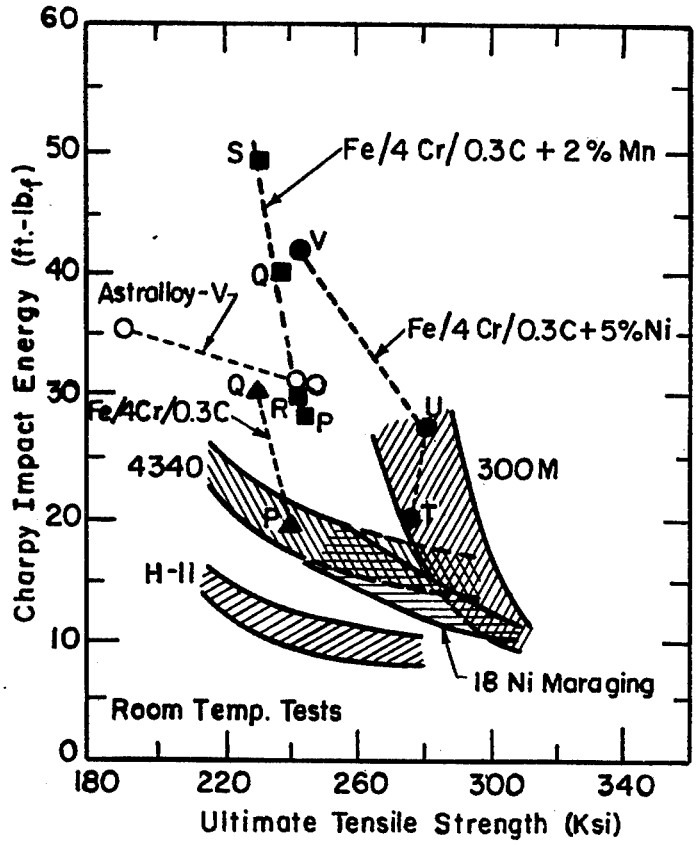
FIG. 12 is a graph illustrating Charpy impact energy plotted against ultimate tensile strength of the subject alloys compared to commercially available products.

Treatment R, illustrated schematically in FIG. 8, comprises treatment Q plus the additional step of reaustenitizing low in the austenite range. This serves to bring out a fine carbide dispersion which promotes a uniform austenite grain size during the second austenitization step. The grain refining heat treatment is suitably performed at a temperature between 870° C. and 900° C. (e.g., 870° C.) followed by an oil quench. The benefit of such double treatment in promoting toughness is illustrated in FIG. 12.

Treatment S is a combination of treatment R with a subsequent tempering at a typical temperature of 200°–250° C. The subsequent tempering steps serve to further improve toughness without adversely affecting strength as shown in FIG. 12.

Figure 7:
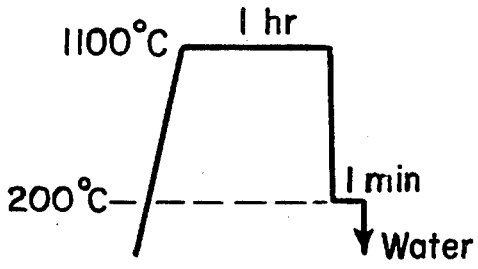

Treatment T, illustrated schematically in FIG. 7, comprises the steps of austenitizing as in the conditions of treatment P followed by an intermediate short tempering treatment (e.g., 1–5 minutes) at 200°–250° C. Thereafter, the product is quenched. Treatment T differs from treatment Q in that tempering occurs prior to quenching. This treatment serves to avoid intergranular cracking and stabilize austenite.

Figure 9:
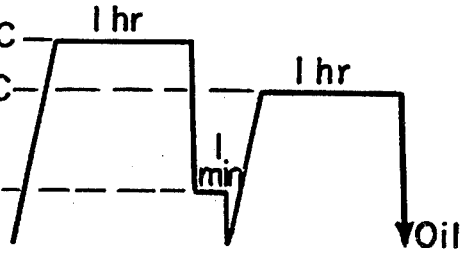

Treatment U, illustrated schematically in FIG. 9, is a combination of treatment T followed by reaustenizing the temperature low in the austenite range (e.g., 850°–900° C.), followed by an oil quench. The reaustenization step serves to provide a finer more uniform austenite grain size. This translates to improved toughness properties at a given strength and is illustrated in Table II.

Treatment V comprises treatment U together with a subsequent intermediate low temperature (e.g., 200°–250° C.) tempering treatment. This subsequent tempering step serves to further improve toughness without adversely affecting strength.

Treatment W is like treatment P except that instead of quenching in oil or water, the steel is cooled in air. Air cooling rather than oil or water quenching serves to produce better combinations of toughness and strength obviating the need for tempering. It is also very economical and it minimizes distortion and residual stresses in heat-treated components. The following table compares the properties of an iron/chromium/carbon steel to which either manganese or nickel has been added and designates the heat treatment of each product. The properties of these products are compared with commercially available alloy steels.

Table II

COMPARISON OF PROPERTIES

| Alloy and Treatment | Ultimate Tensile Strength (psi) | 0.2% Yield Strength (psi) | Impact Strength* (ft-lbs) | Reduction in Area, % | Hardness $R_c$ | Austenite Grain Size (microns) |
|---|---|---|---|---|---|---|
| Fe-4Cr-0.25C-2Mn (Treatment Q) | 235,000 | 195,000 | 40 | 36 | 46 | 280 |
| Fe-4Cr-0.27C-5Ni (TreatmentT) | 275,000 | 195,000 | 19 | 25 | 52 | 165 |
| Fe-4Cr-0.27C-5Ni (Treatment W) | 258,000 | 180,000 | 24.3 | 29 | 48.5 | 165 |
| Fe-4Cr-0.27C-5Ni (Treatment U) | 280,000 | 200,000 | 27 | 44.5 | 49 | 18 |
| Fe-4Cr-0.27C-5Ni (Treatment V) | 242,000 | 193,000 | 41.9 | 57.5 | 47 | 18 |
| Astralloy-V | 241,000 | 157,000 | 31 | 39 | 48 | — |
| SAE 4340 | 230,000 | 200,000 | 10 | 48 | 46 | — |
| Armco 17-4 PH | 200,000 | 185,000 | 15 | 45 | — | — |
| T-1 | 120,000 | 100,000 | 30 | 50 | — | — |
| ASTM-A7 | 65,000 | 33,000 | 60 | 52 | — | — |

*Room Temperature Charpy-V-Notch Test

The above table illustrates the extraordinary combinations of ultimate tensile strength, yield strength, impact strength and hardness of the present product in comparison to those of the prior art. In addition, it illustrates the grain refinement accomplished in treatments U and V in which the austenite grain size is about 18 microns in comparison to treatments Q, T and W in which there is no grain refining double treatment.

Referring to FIGS. 10–13, a variety of properties are illustrated for a number of alloys in accordance with the present invention as a function of the heat treatment history.

Figure 10:
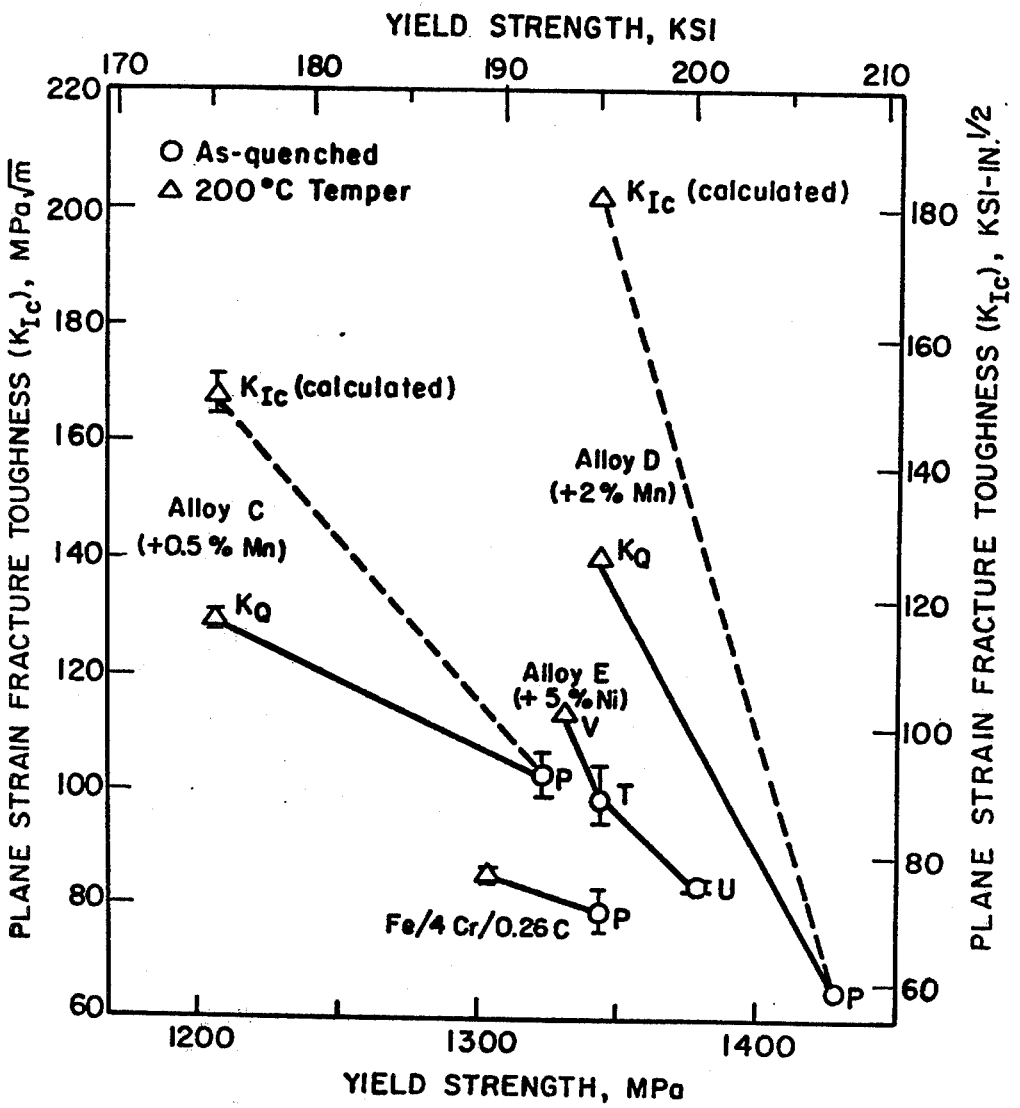
FIG. 10 is a graph illustrating the plane strain fracture toughness properties against yield strength for various manganese or nickel containing alloys in comparison to base alloys of iron, chromium and carbon.
Figure 11:
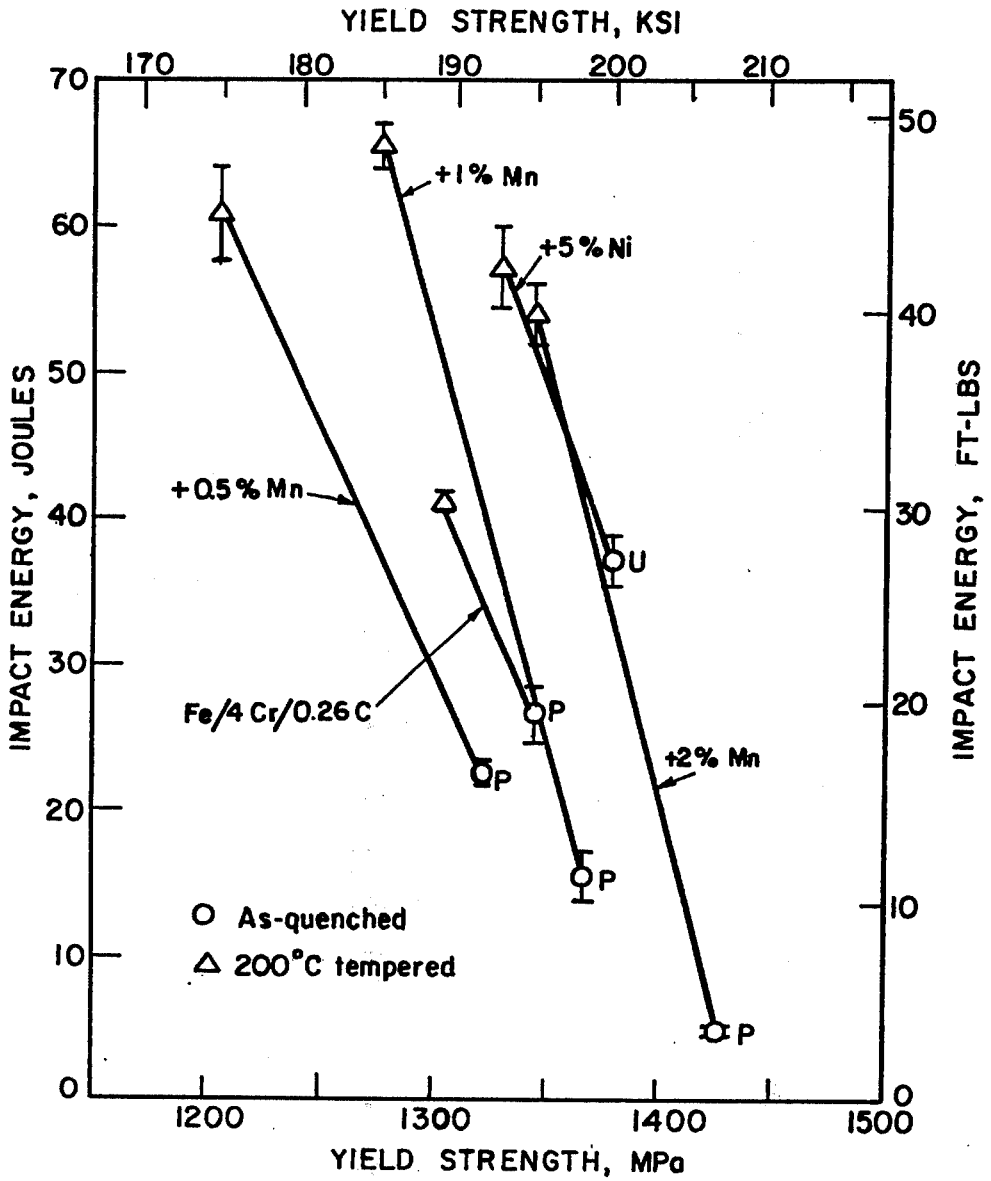
FIG. 11 is a graph plotting the impact toughness properties against yield strength for nickel or manganese alloys of a base chromium carbon product.

Referring to FIG. 10, the plane strain fracture toughness ($K_{Ic}$) is plotted in KSI-in$^{\frac{1}{2}}$ against yield strength in KSI for a variety of nickel or manganese alloys of the alloy of iron/4% chromium/0.26% carbon. As used herein, the term "base alloy" refers generally to such a ternary iron/chromium/carbon alloy. The $K_{Ic}$ actual and calculated are both plotted for a variety of heat treatments. It is apparent that both the manganese and nickel alloys are vastly superior to the base steel without such alloying elements. The significance of measurements of $K_{Ic}$ (calculated) and KQ and the methods of calculating the same are set forth in ASTM designation E3999-72 and in Chell, G., Milne, I., and Kirby, J., *Metals Technology*, 2, 549 (1975). Tempering causes the toughness values for the present products (including manganese or nickel) to increase to a significant extent while it has little effect on the base alloy without manganese or nickel. This is believed to be due to the ability of the manganese or nickel to stabilize and retain the austenite at boundaries between adjacent martensite crystals.

FIG. 12 is a plot of Charpy impact energy in ft.-lbs. versus ultimate tensile strength for (a) a base alloy of iron/4% chromium/0.3% carbon, (b) alloys of 2% manganese and 5% nickel alloy, and (c) various commercial alloy steels. The letter designations refer to the symbols of heat treatment as set forth in Table I. It is apparent from FIG. 12 that the alloys of the present invention are characterized by high ultimate tensile strength in combination with high Charpy impact energy under the illustrated heat treatments. It is particularly significant that Charpy impact energy reaches levels in the 30 to 50 ft.-lb. range, far superior to the base alloy or the illustrated commercial steels.

Figure 13:
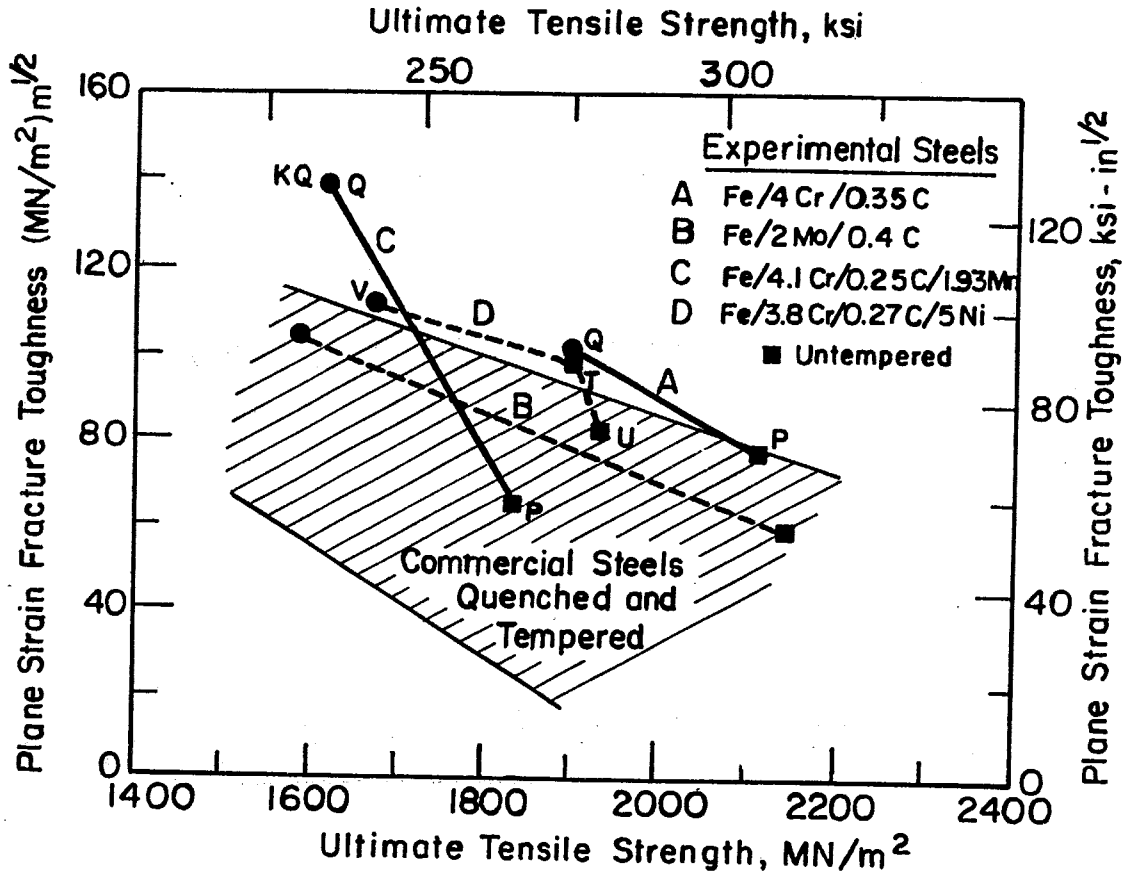
FIG. 13 is a graph illustrating plane strain fracture toughness plotted against tensile strength for the alloys of the present invention compared to commercially available products.

Referring to FIG. 13, plane strain fracture toughness (KSI-in$^{\frac{1}{2}}$) is plotted against ultimate tensile strength (KSI) for the illustrated base alloy and for alloys including manganese and nickel. It is apparent that the highest values for toughness are illustrated by the product of the present invention, especially after tempering. They are vastly superior to the comparable commercial alloy steels.

The steels of the present invention are characterized by the combination of the following physical properties. They include a yield strength of at least about 180,000 psi, a room temperature Charpy impact energy of at least about 19–25 lbs., and a plane strain fracture toughness ($K_{Ic}$) of at least about 80 KSI-in$^{\frac{1}{2}}$. In addition, such product is preferably characterized by a ratio of tensile strength to yield strength of greater than 1.15 and a Rockwell ($R_c$) hardness of greater than 46. Other properties of this exceptional product are illustrated in Table II and FIGS. 10–13. Optimal properties, especially toughness, are imparted to the product as a result of heat treatment subsequent to initial austenitization—specifically tempering, reaustenitization, or both. This alloy steel can be heat treated because of the presence of substitutional alloying elements, preferably nickel and/or manganese, in addition to chromium in the steel which serves to stabilize the austenite films against transformation during and after treatment.

Steels of the foregoing type are particularly suitable for use in the mining industry due to their combined properties of high toughness and strength. They resist wear and gross failures due to inadequate toughness and lowered energy efficiency due to low load bearing capacity. For example, the steels have exceptional properties for use as that part of equipment impacted by ore during mining, e.g., buckets, shovels, dipper teeth, plows, track shoes, scraper blades, and the like. Suitable ores include coal, iron ore, copper ore, molybdenum ore, etc. As a specific application, the steels may be used for bucket supporters, the load critical part of earth moving equipment, which permits the use of larger buckets.

Another mining industry use for which the foregoing steels have exceptional properties is for ore comminution equipment. Thus, it may be employed as balls, rods or other grinding media as well as for liners for the corresponding mills.

The wear property of a metal may be determined under sliding wear conditions in a "pin on disc" test. The extraordinary wear properties of a steel according to the present invention compared to other steels by tests set out is in the following table.

Table III

| Material | Weight Loss (mg) |
|---|---|
| Fe-4Cr-0.3C-2Mn (quenched and tempered) | 0.21* |
| Fe-4Cr-0.4C (quenched) | 0.63** |
| Fe-4Cr-0.4C (quenched and tempered) | 2.41** |
| AISI 1020 (0.20% C mild steel) | 98.99** |

*Test conditions duration - 2 hours; normal load 3.95 kg; sliding speed: 0.157 meters/sec.
**Test conditions duration - 2 hours; normal load 5.0 kg; sliding speed - 1 meter/sec.

What is claimed is:

1. The method of forming a high strength, tough alloy carbon steel comprising heating an alloy steel to a temperature above the austenite transformation temperature to form a homogeneous austenite phase with the alloying elements in solution, and cooling the steel to transform the major portion of austenite to martensite at a temperature of at least about 250° C. to form a microstructure of uniformly dispersed martensite crystals, the major portion of which are in dislocated form, and continuous thin boundary films of stabilized austenite essentially free of carbides separating said martensite crystals, said steel being characterized by a yield strength of at least about 180,000 psi, a room temperature Charpy impact energy of at least about 19 ft/lbs. and a plane strain fracture toughness ($K_{IC}$) of at least about 80 KSi-in$^{\frac{1}{2}}$, said steel consisting essentially of from about 0.20 to about 0.35 weight % carbon, about 3.0 to 4.5 weight % chromium, and at least 1 weight % of at least one other substitutional alloying element selected from the group consisting of nickel, manganese, molybdenum, cobalt, silicon, aluminum, and mixtures thereof, said steel including a maximum alloy content below that which lowers the martensite transformation temperature to below 250° C.

2. The method of claim 1 in which the austenite of said heat treated steel is stable against transformation at a temperature of at least 200° C.

3. The method of claim 1 together with the step of refining the martensite grain size of said heat treated steel by reheating it to the austenite range and recooling it to form the same type of microstructure with a refined austenite grain size.

4. The method of claim 1 in which said heat treated steel is thereafter tempered at a temperature of about 200° C.

5. The method of claim 1 in which the ratio of tensile strength to yield strength of said heat treated steel is greater than 1.15.

6. The method of claim 1 in which the $R_c$ hardness value of said heat treated steel is greater than 46.

7. The method of claim 1 in which said substitutional alloying element is selected from the group consisting of nickel, manganese, and mixtures thereof.

8. The method of claim 1 in which said alloy steel is heated to a maximum temperature in the range of 1000° C.–1100° C. in said heating step.

9. The product formed by the method of claim 1.

* * * * *